United States Patent [19]

Ratnik

[11] Patent Number: 4,989,830

[45] Date of Patent: Feb. 5, 1991

[54] MOTORIZED HYDRANT

[75] Inventor: H. Ronald Ratnik, Pittsford, N.Y.

[73] Assignee: Ratnik Industries, Inc., Victor, N.Y.

[21] Appl. No.: 470,812

[22] Filed: Jan. 26, 1990

[51] Int. Cl.[5] ..... F16K 31/04; F16K 31/50

[52] U.S. Cl. ..... 251/129.11; 251/273; 251/274

[58] Field of Search ..... 251/129.11, 264, 273, 251/274

[56] References Cited

U.S. PATENT DOCUMENTS 4,556,193 12/1985 Yoshiga ..... 251/273 X
4,564,003 1/1986 Iwanicki et al. ..... 251/129.11 X

FOREIGN PATENT DOCUMENTS 62-28589 2/1987 Japan ..... 251/264

*Primary Examiner*—Arnold Rosenthal
*Attorney, Agent, or Firm*—Warren W. Kurz

[57] ABSTRACT

A rotatable valve stem in a fluid (e.g. water) hydrant controls the axial position of a plug relative to a valve seat to control fluid-flow through the valve seat. The valve stem is threaded into a bushing of the hydrant so that rotational movement of the stem causes axial movement thereof. According to the invention, rotation of such valve stem is motorized by the coupling of a rotatably-driven drive shaft of an electric motor to the valve stem. The motor and, optionally, a gearing arrangement are enclosed by a protective housing supported by the hydrant. The motor is slidably mounted within the protective housing to accommodate axial movement of the motor caused by the axial movement of the valve stem and its coupled motor drive shaft. According to a preferred embodiment, such sliding movement is effected by the combination of one or more pins operatively coupled to the motor and extending radially outward relative to the motor drive shaft axis, and a like number of axially-extending slots formed in the protective housing and adapted to receive and guide such pins.

3 Claims, 3 Drawing Sheets

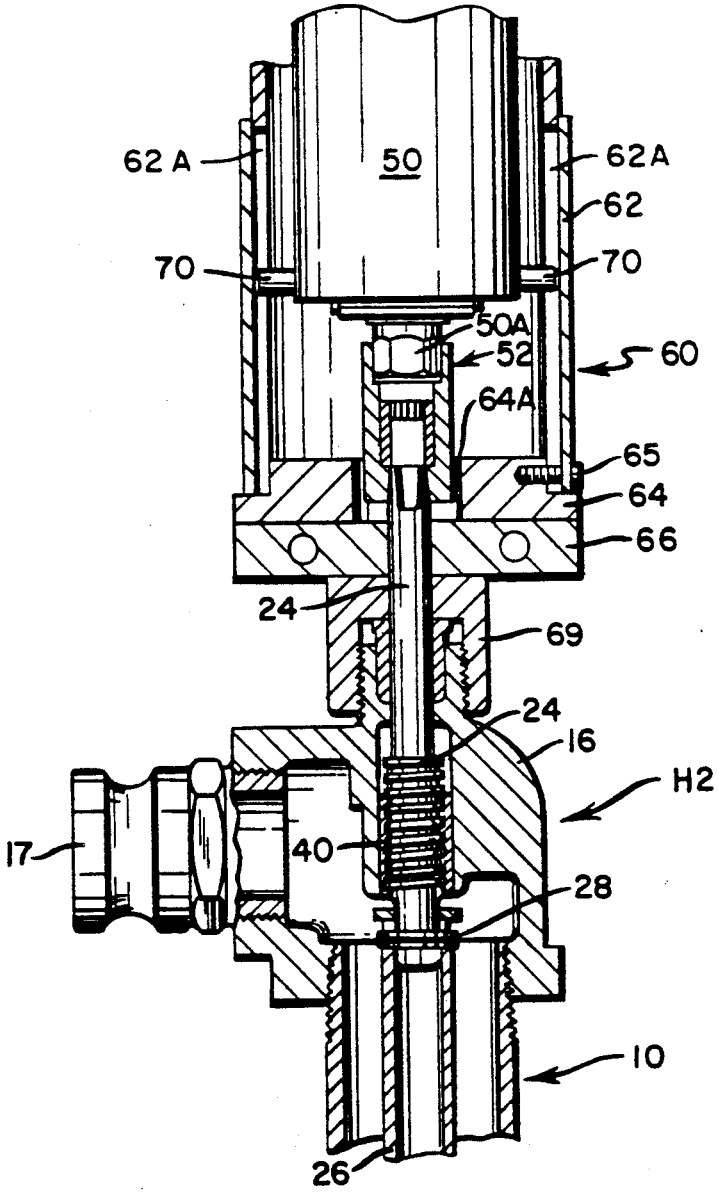
FIG. 3
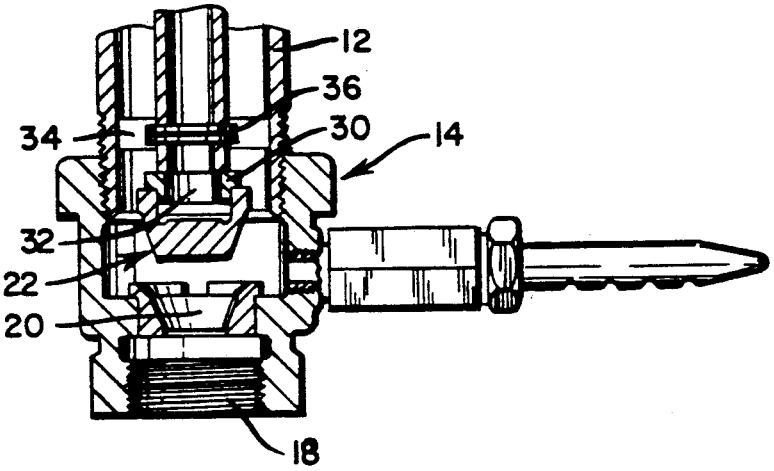

MOTORIZED HYDRANT

CROSS-REFERENCE TO RELATED APPLICATIONS

Reference is made to the commonly assigned U.S. application Ser. No. 07/470,955, filed concurrently herewith in the names of H. R. Ratnik, M. R. Meadows, and J. L. Stephens, and entitled AUTOMATED SNOW-MAKING SYSTEM.

BACKGROUND OF THE INVENTION

The present invention relates to improvements in water hydrants and the like, such as those used in the art of snow-making for supplying water under high pressure to a snow-making device which acts to combine such water with compressed air to produce man-made snow. More particularly, this invention relates to apparatus for motorizing the opening and closing of a valve seat in such hydrants to control the flow of fluid therethrough.

In the commonly assigned U.S. patent application referenced above, there is disclosed an automated snow-making system which includes a remote-controlled circuit for controlling the opening and closing of valves in compressed air and water hydrants. By controlling the relative proportion of compressed air and water supplied to a snow-making device or "snow-gun", the snow quality (moisture content) can be adjusted to achieve a desired result at ski centers and resorts. In the system disclosed, the control circuit operates a bi-directional motor having a drive shaft operatively coupled to the valve stem of a water hydrant. As the drive shaft rotates, it rotates the valve stem of the hydrant through a high gear-reduction gear box. Rotation of the valve stem in conventional hydrants causes axial movement of the stem and of a plug to which the stem is connected. The plug cooperates with a valve seat to control fluid-flow through the valve seat.

In many hydrants of the above type, a substantial axial displacement of the valve stem is required in order to move the plug between a position in which it fully closes the valve seat, and a position in which it allows uninhibited flow of fluid through the seat. In the hydrant disclosed in the above-referenced application, such displacement amounts to about 2 to 3 centimeters. When a motor is used to effect rotation of the valve stem, some accommodation must be made to compensate for the axial movement of the end of the valve stem toward and away from the end of the motor shaft. While complex stem/shaft couplings (e.g., rack end pinion arrangements) have been considered to provide this accommodation, such couplings may be difficult and, hence, costly to fabricate.

SUMMARY OF THE INVENTION

In view of the foregoing, an object of this invention is to provide a motorized hydrant apparatus in which the above-identified stem/shaft accommodation problem is eliminated.

Like most known hydrant apparatus, the hydrant apparatus of the invention includes (a) a housing including means defining (i) a valve seat through which a fluid can enter such housing and (ii) an outlet through which a fluid within such housing can exit therefrom; (b) a plug adapted to cooperate with the valve seat for controlling the flow of fluid into the housing through such valve seat; (c) a valve stem operatively coupled to the plug for controlling its position relative to the valve seat, such valve stem having an end portion disposed outside the housing; and (d) threaded means supported by the housing for rotatably supporting the valve stem and for converting rotational movement of such valve stem to axial movment thereof, whereby the plug is moved toward and away from the valve seat during rotational movement of the valve stem. Unlike conventional hydrant apparatus, however, the hydrant apparatus of the invention further comprises (e) motor means for rotatably driving the valve stem, such motor means comprising a rotatably-mounted drive shaft, a bi-directional electric motor adapted to selectively rotate such drive shaft in either of opposite directions, and coupling means for operatively coupling the drive shaft with the end portion of the valve stem; and (f) mounting means for movably mounting the motor means on the housing to allow the motor means to move in a direction parallel to the longitudinal axis of the valve stem in order to accommodate the axial movement of the valve stem occasioned by the rotational movement thereof by the motor means.

The invention will be better understood from the ensuing detailed description of a preferred embodiment, reference being made to the accompanying drawings in which like reference characters denote like parts.

BRIEF DESCRIPTION OF THE DRAWING

FIG. 3 is a cross-section of the hydrant apparatus shown in FIG. 2.

DETAILED DESCRIPTION OF A PREFERRED EMBODIMENT

Figure 1:
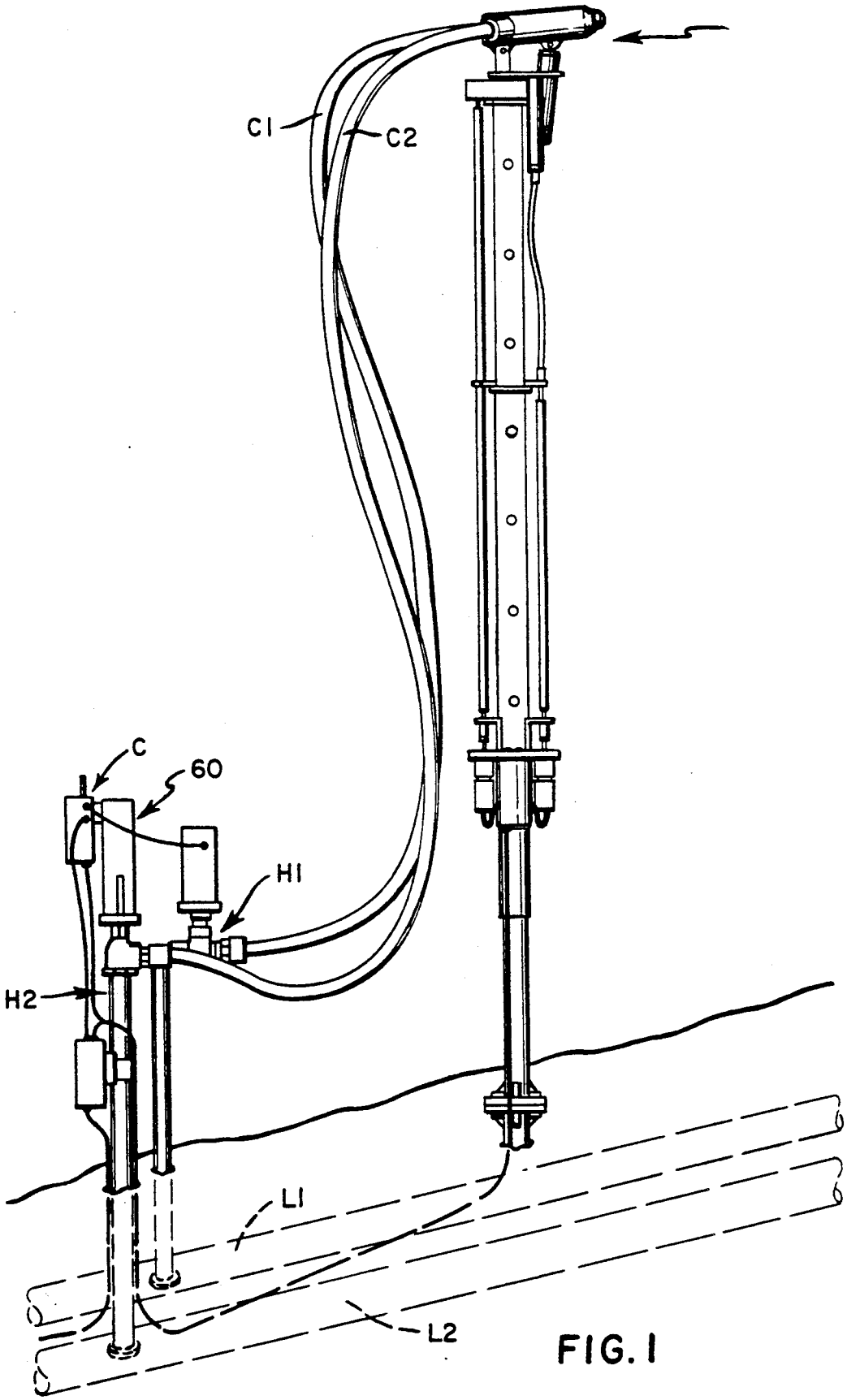
FIG. 1 is a side elevation of an automated snow-making system embodying the hydrant apparatus of the invention.

Referring now to the drawings, FIG. 1 illustrates an automated snow-making system embodying the hydrant apparatus of the invention. Such system is fully disclosed in the above-referenced application. Briefly, such system includes a snow-gun G which functions to combine compressed air and water under high pressure to produce man-made snow. The consistency of such snow is determined, in large part, by the compressed air-to-water ratio and ambient temperature. Compressed air and water are supplied to the snow-gun by conduits C1 and C2, respectively, which are connected to compressed air and water lines, L1 and L2, respectively by a pair of hydrants H1 and H2. The relative outputs of the hydrants determines the air-to-water ratio. The compressed air hydrant H1 merely comprises a ball valve which fully opens and closes by rotating a valve stem by ninety degrees. Hydrant H2, on the other hand, has a more complicated valving arrangement, as shown in FIG. 3, which requires multiple turns of a valve stem to fully open an internal valve (described below) from a fully closed position. Thse valve stem of each hydrant is rotated by a motor which is operated by a control circuit C which, as disclosed in the aforementioned application, can be operated from a remote location. The structural details of hydrant H2 will now be described.

Hydrant H2 comprises a housing 10 which includes a steel riser pipe 12 to which a valve seat assembly 14 is threaded at its lower end. the valve seat assembly controls the flow of water into housing 10. Threaded to the top of the riser pipe is a bonnet 16 which defines an outlet 17 through which water can flow from housing 10.

The valve seat assembly comprises a threaded inlet 18 which communicates with a valve seat 20. The flow rate of water into the interior of housing 10 through the valve seat is controlled bya plug 22 which is rigidly connected to a valve stem 24 by an extension tube 26. A spring pin 38 serves to connect the extension tube to the valve stem. Plug 22 is threaded to the outer surface of a lock nut 30 which, in turn, is supported by a disc adapter 32 connected to the lower end of the extension tube. The lower end of the extension tube is concentrically maintained with respect to the riser pipe by a spider assembly 34 which is connected to the lower end of the extension tube by a spring pin 36.

Valve stem 24 is threaded into an inner sleeve 40 which is press fit into a cylindrical bore formed in the interior of bonnet 16. Thus, as valve stem 24 rotates, it moves axially within the threaded sleeve 40, thereby moving plug 22 toward and away from the valve seat, depending on the direction of rotation. As may be appreciated from the drawing, in order to move plug 22 to a position allowing uninhibited flow of water through the valve seat, stem 24 must undergo substantial axial movement. Such axial movement must be accommodated by any mechanism designed to rotate the valve stem.

Figure 2:
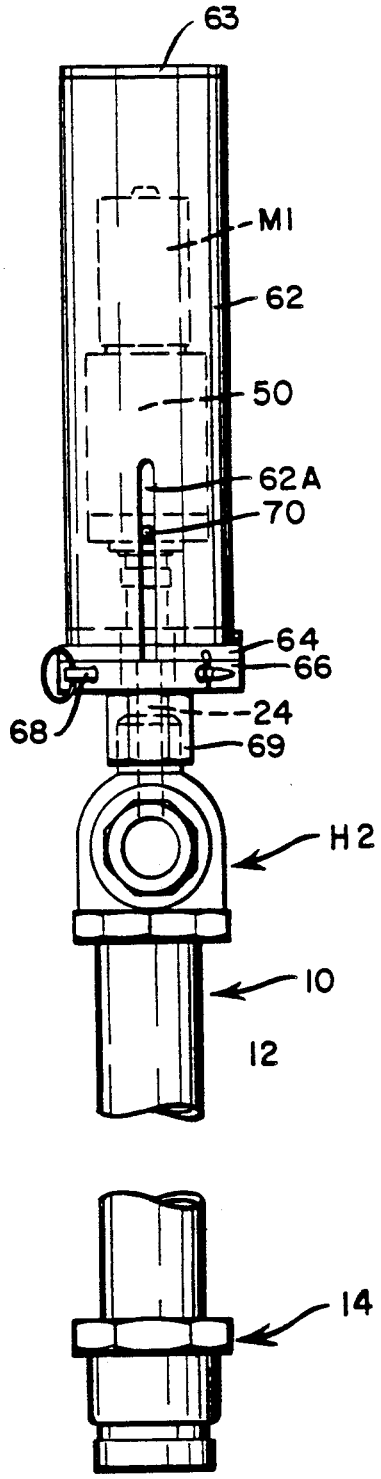
FIG. 2 is a front elevation of a water hydrant incorporating the inventive features of the invention.

As best shown in FIG. 2, rotation of threaded valve stem 24 within the threaded sleeve 40 is selectively effected by a bi-directional electric motor M1. The motor drive shaft (not shown) operates a high gear ratio (e.g. 300:1) gear box 50 which serves to rotate a drive shaft 50A of hexagonal cross-section. A tubular coupling member 52 having a suitably shaped hexagonal opening at one end to engage drive shaft 50A and a suitably shaped (e.g. oval) opening at the other end to engage a tapered end of the valve stem, serves to couple the rotary motion of the drive shaft to the valve stem. Motor M1 and its associated gear box 54 are disposed in a protective cylindrical housing 60 comprising a tubular member 62 which is closed at its top end by a cap 63. The bottom end of member 62 is partially closed by a mounting flange 64 having a central opening for receiving the valve stem. Flange 64 is connected to housing member 62 by fasteners 65. Flange 64 is releasably connected to a platform 66 by a pair of removable pins 68, each passing through a hole 66A in the side of platform 66 and into a mating hole (not shown) formed in a downwardly depending extension forming a part of the mounting flange. This "quick disconnect" mounting arrangement allows quick access to the valve stem, for example, in case of a power failure, in which case the valve stem must be turned manually by a handle which mates with the top of the valve stem. Platform 66 is fastened to the top of a hex-shaped cap 69 which is threaded to the top of bonnet 16. Cap 69 is provided with an aperture for allowing the valve stem to protrude upwardly therethrough.

In order to accommodate the axial movement of the valve stem as it rotates under the influence of drive shaft 54A, motor M1 and its associated gear box 54 are slidably mounted within housing member 62 by a pin-and slot arrangement. More specifically, a pair of axially-extending opposing slots 62A are formed in member 62, such slots being adapted to receive a pair of pin members 70 rigidly connected to and extending radially outward from the lower portion of the gear box. Thus, during axial movement of the valve stem, the motor and gear box move axially within housing 60 owing to the coupling between the drive shaft and valve stem by coupling member 52. Pin members 70 function to prevent the motor assembly from rotating within housing 60, and serve to constrain the movement of the motor assembly to one degree of freedom, i.e., axial movement.

From the foregoing, it will be appreciated that a simple, yet highly reliable, apparatus has been provided for accommodating the axial movement of the valve stem in a motor-driven hydrant. Moreover, the motor-control mechanism can be quickly and easily removed from the hydrant to provide ready access to the valve stem in case of power failure.

The invention has been described with particular reference to a preferred embodiment. It will be appreciated that modifications can be made without departing from the spirit of the invention, and such modifications are intended to fall within the scope of the appended claims.

I claim:

1. A motorized hydrant apparatus for controlling the flow of a fluid, said hydrant apparatus comprising:

(a) a first housing including means defining (i) a valve seat through which a fluid can enter said first housing and (ii) an outlet through which a fluid within said first housing can exit therefrom;

(b) a plug adapted to cooperate with said valve seat for controlling the flow of fluid into said first housing through said valve seat;

(c) a valve stem operatively coupled to said plug for controlling the position of said plug relative to said valve seat, said valve stem having an end portion disposed outside said first housing;

(d) threaded means in said first housing for rotatably supporting said valve stem and for converting rotational movement of said valve stem to axial movement of said valve stem, whereby said plug is moved toward and away from said valve seat during rotational movement of said valve stem;

(e) motor means for rotatably driving said valve stem, said motor means comprising a rotatably-mounted drive shaft, a bi-directional electric motor adapted to selectively rotate said drive shaft in either of opposite directions, and coupling means for operatively coupling said drive shaft with the end portion of said valve stem;

(f) mounting means for slidably supporting said motor means on said first housing to allow said motor means to slide in a direction parallel to the longitudinal axis of said valve stem in order to accommodate the axial movement of said valve stem occasioned by the rotational movement thereof by said motor means; and (g) a second housing for protectively enclosing said motor means, said second housing being rigidly connected to said first housing, said motor means being slidably supported within said second housing.

2. The apparatus as defined by claim 1 wherein said motor means comprises at least one pin member extending radially outward with respect to the longitudinal axis of said drive shaft, and means defining an axially-extending slot in said second housing for receiving and guiding said pin member.

3. The apparatus as defined by claim 1 wherein said second housing is releasably connected to said first housing.

* * * * *